US010041273B2

(12) United States Patent
Dieguez

(10) Patent No.: US 10,041,273 B2
(45) Date of Patent: Aug. 7, 2018

(54) STRIKE PLATE LOCK

(71) Applicant: Robert Francis Dieguez, Lancaster, CA (US)

(72) Inventor: Robert Francis Dieguez, Lancaster, CA (US)

( * ) Notice: Subject to any disclaimer, the term of this patent is extended or adjusted under 35 U.S.C. 154(b) by 67 days.

(21) Appl. No.: 14/683,748

(22) Filed: Apr. 10, 2015

(65) Prior Publication Data

US 2016/0298361 A1 Oct. 13, 2016

(51) Int. Cl.

| | |
|---|---|
| ***E05B 15/02*** | (2006.01) |
| ***E05B 63/00*** | (2006.01) |
| ***E05C 17/50*** | (2006.01) |
| ***E05C 19/18*** | (2006.01) |

(52) U.S. Cl.

CPC ..... *E05B 15/0205* (2013.01); *E05B 63/0052* (2013.01); *E05C 17/505* (2013.01); *E05C 19/182* (2013.01); *Y10S 292/15* (2013.01)

(58) Field of Classification Search

CPC .. E05B 15/0205; E05B 17/20; E05B 17/2084; E05B 63/0052; E05C 17/02; E05C 17/46; E05C 17/50; E05C 17/505; E05C 19/182; E05C 19/18; Y10T 292/34; Y10T 292/37; Y10T 292/394; Y10T 292/397; Y10T 292/444; Y10T 292/68; Y10T 292/283; Y10S 292/15

USPC ..... 292/288, 289, 297, 298, 304, 340, 292/DIG. 15, 264; 49/394

See application file for complete search history.

(56) References Cited

U.S. PATENT DOCUMENTS

| | | | | | |
|---|---|---|---|---|---|
| 267,035 | A | * | 11/1882 | Streeter | E05C 19/182 292/298 |
| 456,267 | A | * | 7/1891 | Davis | E05C 19/182 292/298 |
| 787,847 | A | * | 4/1905 | Kollme | E05C 19/182 292/297 |
| 827,624 | A | * | 7/1906 | Foster | E05C 19/18 292/288 |
| 1,234,158 | A | * | 7/1917 | Hall | E05C 19/182 292/295 |
| 1,744,456 | A | * | 1/1930 | Ellingson | E05C 17/32 292/263 |

(Continued)

FOREIGN PATENT DOCUMENTS

| | | | | |
|---|---|---|---|---|
| WO | WO 0107739 A1 | * | 2/2001 | E05B 17/005 |

*Primary Examiner* — Christine M Mills

(74) *Attorney, Agent, or Firm* — Omni Legal Group; Omid E. Khalifeh

(57) ABSTRACT

An auxiliary lock for preventing a hinged door from opening all the way is provided. The lock comprises a strike plate, a flip lock plate, a catching member to receive a door knob or handle, and a means for connecting the catching member and flip lock plate. In an embodiment, the strike plate may be configured to replace any standard strike plate disposed on an inside portion of a door jamb, and the flap lock plate may longitudinally extend from a hinged connection with strike plate in the direction of an opening door so as to optionally block the door from opening and avoid obstructing a swinging door when disengaged. In use, the catching member may be placed around the door knob or handle so that the means for connecting the catching member and flip lock plate form an inseparable link between the door jamb and door itself.

14 Claims, 5 Drawing Sheets

(56) References Cited

U.S. PATENT DOCUMENTS 2,199,369 A * 4/1940 Bernstein ..... E05C 17/36 292/262
2,288,022 A * 6/1942 O'Brien ..... E05C 19/182 248/68.1
2,726,112 A * 12/1955 Conhagen ..... E05B 15/0205 292/264
2,794,665 A * 6/1957 Sasse ..... E05C 19/18 16/351
3,313,566 A * 4/1967 Sipes ..... E05C 17/365 292/292
3,451,708 A * 6/1969 Brooks ..... E05C 17/365 292/264
3,640,558 A * 2/1972 Gewertz ..... E05C 17/365 292/264
3,809,418 A * 5/1974 Canfield ..... E05C 17/365 292/264
3,810,667 A * 5/1974 Dugan ..... E05C 3/048 292/297
3,853,343 A * 12/1974 Hunter ..... E05C 17/365 24/299
4,022,503 A * 5/1977 Bey ..... E05C 19/182 24/116 R
4,135,748 A * 1/1979 Roberts ..... E05C 19/182 292/298
4,155,577 A * 5/1979 Raymond ..... E05C 17/365 292/264
4,155,578 A * 5/1979 Rolland ..... E05C 19/182 292/292
4,575,140 A * 3/1986 Dargis ..... E05C 19/184 292/288
4,605,251 A * 8/1986 Finlay ..... E05C 19/18 292/147
4,629,229 A * 12/1986 Correnti ..... E05C 19/18 292/246
4,917,422 A * 4/1990 Rose ..... E05C 19/182 292/264
5,269,100 A * 12/1993 Fontenot ..... E05B 17/2084 49/460
5,462,319 A * 10/1995 Roden, Jr. ..... E05C 17/365 292/264
6,416,089 B1 * 7/2002 Williams, Jr. ..... E05C 19/182 292/288
6,641,185 B2 * 11/2003 Hale ..... E05C 19/184 292/289
6,863,319 B1 * 3/2005 Bentley ..... E05C 17/36 292/253
6,976,716 B2 * 12/2005 Lin ..... E05C 19/182 292/288
2007/0085352 A1 * 4/2007 Ulanday ..... E05C 17/365 292/288

* cited by examiner

STRIKE PLATE LOCK

CROSS-REFERENCE TO RELATED APPLICATIONS

Pursuant to 35 USC 119, this application claims the right of priority to Provisional Patent Application Ser. No. 61/995,665 filed on Apr. 16, 2014. The content of said application is incorporated herein by reference in its entirety.

GOVERNMENT CONTRACT

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material that is subject to copyright protection. This patent document may show and/or describe matter that is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to devices for securing a hinged door against intruders and, more particularly, to a flip lock and linking assembly integrated as with a strike plate that is configured to replace any existing strike plate disposed on a door jamb.

BACKGROUND

A variety of locks, deadbolts, chains and latches have been used as forms of security for preventing unwelcome access through a door. Unfortunately, due to their respective shapes and configuration with respect to a door frame, many of these are prone to failure under surprisingly little force.

For example, door chains and bar locks mounted on an outer side of a door frame and slideably engageable with mountings attached on a face of the door itself are ubiquitous and commonly available in the marketplace to provide additional security for private homes, offices, and hotels alike. However, because such locks are secured with screws and bolts placed parallel to the initial direction of an openly swinging door, force applied to the door may easily cause the screws and bolts to fail, pulling the mount itself free from the door and/or door jamb. Sufficient force may even cause the chain or bar to break or come unsecured from its mount.

As another example, deadbolts are commonly attached along an inner edge of a door to engage with the door jamb in a position perpendicular to the initial direction of an openly swinging door. Although the bolts themselves are sturdy enough to withstand high forces, they are known to physically tear through doors and doorframes. This not only allows a hinged door to admit possible intruders, but also damages the door and door frame in the process. Deadbolts even have an additional disadvantage of being susceptible to lock picking from the outside.

Attempts have been made to solve these problems. U.S. Pat. No. 4,575,140 to Dargis, for instance, discloses a door fastener that operates by connecting a strike plate in a door jamb to a plate slotted for positioning over a door handle. U.S. Pat. No. 6,641,185 to Hale et al. discloses a strike plate having two apertures for receiving arm portions of a U-Bar that partially encircles a shank portion of a door knob. Although each of these solutions avoid some of the shortcomings of the aforementioned locks, they require the door to remain completely closed while the lock is in use. This may prevent individuals protected by the locked door from securely screening visitors before deciding whether or not to permit entry.

Although various proposals have been made to solve the problem, none of those in existence combine the characteristics of the present invention. Therefore, there is a need for a lock that can be readily incorporated into the existing structure of the door jamb independent of a need to modify it. Moreover, there is a further need for a lock that optionally maintains the door in a completely closed position or prevents the door from being fully opened to admit potential intruders or unwanted guests.

SUMMARY

The present disclosure is directed to an auxiliary lock configured to stop the opening motion of a hinged door in order to prevent intruders or other unwelcome guests from entering through the door. More particularly, a strike plate lock comprises a strike plate, a flip lock plate hingedly connected to the strike plate, a catching member to receive a door knob or handle, and a means for connecting the catching member to the flip lock plate. The means for linking the catching member, which may be a hook or a hoop, and the strike plate secured on an inner side of a door jamb are provided so that when the catching member is engaged with the door knob or handle the means for linking may stop the door from opening all the way. To provide additional security, the flip lock plate, as with flip locks typically available in the marketplace, may be engaged over a portion of the door facing the direction of its opening swing in order to prevent the door from opening at all.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In an embodiment, the strike plate may be configured to replace any standard strike plate disposed on an inner surface of a door jamb to receive a latch or bolt. Thus, it is contemplated that the strike plate has longitudinally opposed first and second sides and comprises an aperture for receiving a latch disposed between said first and second sides. As with a standard strike plate, the disclosed strike plate may be arranged so that, when disposed on the inside of the door jamb, the first side longitudinally aligns with a portion of the door jamb facing the direction of a hinged door swinging toward an open position. Likewise, when disposed on the inside of the door jamb, the second side may longitudinally align with a portion of the door jamb facing the direction of a hinged door swinging toward a closed position.

The strike plate may further comprise a plurality of additional apertures for receiving screws, nails, bolts, dowels or any other means for securing the strike plate to the inner surface of the door jamb. Configured in this manner, it is contemplated that the disclosed strike plate may be disposed on the door jamb in place of a standard strike plate, independent of any need to modify existing structures.

Of course these apertures may be as numerous or few as necessary to conform to the particular needs of the door and door jamb. For example, some strike plates are known in the art that have two, three, four, or even more apertures for receiving elongated screws to secure the strike plate to the inside of the door jamb. The ability to conform to spaces provided for various standard strike plates may be particularly desirable in instances where a user, such as a renting tenant, wishes to add security to his or her living space while avoiding altering the property in any manner that may constitute damage in breach of a lease or even cause property value to depreciate. For example, many agreements prevent tenants from putting new holes in the walls and other structures in the property. Thus it may be desirable to provide a strike plate which avoids the need to add holes or otherwise modify the door and/or door frame. Instead, in one embodiment, the strike plate may be affixed to the inner surface of the door jamb using any existing strike plate screw holes, and two screws.

Next, the flip lock plate may extend from the first side of the strike plate in the direction of an openly swinging door. The means for linking the catching member and flip lock plate may be a chain or rugged chord which is secured on one end to the flip lock plate and on the other to the catching member.

In one embodiment, the catching member may be a hoop sized to fit over any of a door knob or door handle. In another embodiment, the catching member may be a hook. It is contemplated, however, that the catching member may be any shape capable of removeably catching the handle of a door so that when placed around the door knob or handle, the means for connecting the catching member and flip lock plate form a link between the door jamb and door itself.

It is contemplated that the flip lock plate may be hingedly attached to the strike plate so that when the catching member is not engaged around the door knob or hook, it may rest outside of the door frame. In other words, in an embodiment, a hinged connection may prevent an unused strike plate lock from obstructing the path of a swinging door. It is also contemplated, however, that this effect may be achieved by providing a flip lock plate that is bent to conform to the shape of an outer side of the door jamb. In another embodiment, the flip lock plate hingedly extends from the first side of the strike plate so that it may optionally block the door from swinging open at all.

The strike plate, flip lock plate, catching member, and means for linking the catching member and flip lock plate may comprise rugged material such as metal. For example, in an embodiment, the material may be stainless steel known in the art for its particular durability and strength. Of course, this is offered by way of example only and not of limitation. Indeed, it is contemplated that the strike plate, flip lock plate, catching member, and means for linking the catching member and means for linking the catching member and flip lock plate may comprise various other materials or combinations of materials capable of withstanding the force of a potential intruder. Indeed, the rugged material may be chosen from stainless steel, steel, aluminum, or even iron. Such materials may be further alloyed with additional materials such as chromium and nickel to increase durability, hardness, and corrosion resistance.

Thus it is an object of the invention to provide a security device which optionally prevents a door from opening or allows a door to open partially while in use.

It is an even further object of the invention to provide a security device which may be incorporated into the existing door and door jamb structure independent of a need to modify the same.

It is a further object of the invention to provide a security device which avoids obscuring the path of a swinging door while not in use.

One or more of the above-disclosed embodiments, in addition to certain alternatives, are provided in further detail below with reference to the attached figures. The disclosed subject matter is not, however, limited to any particular embodiment disclosed.

Figure 1:
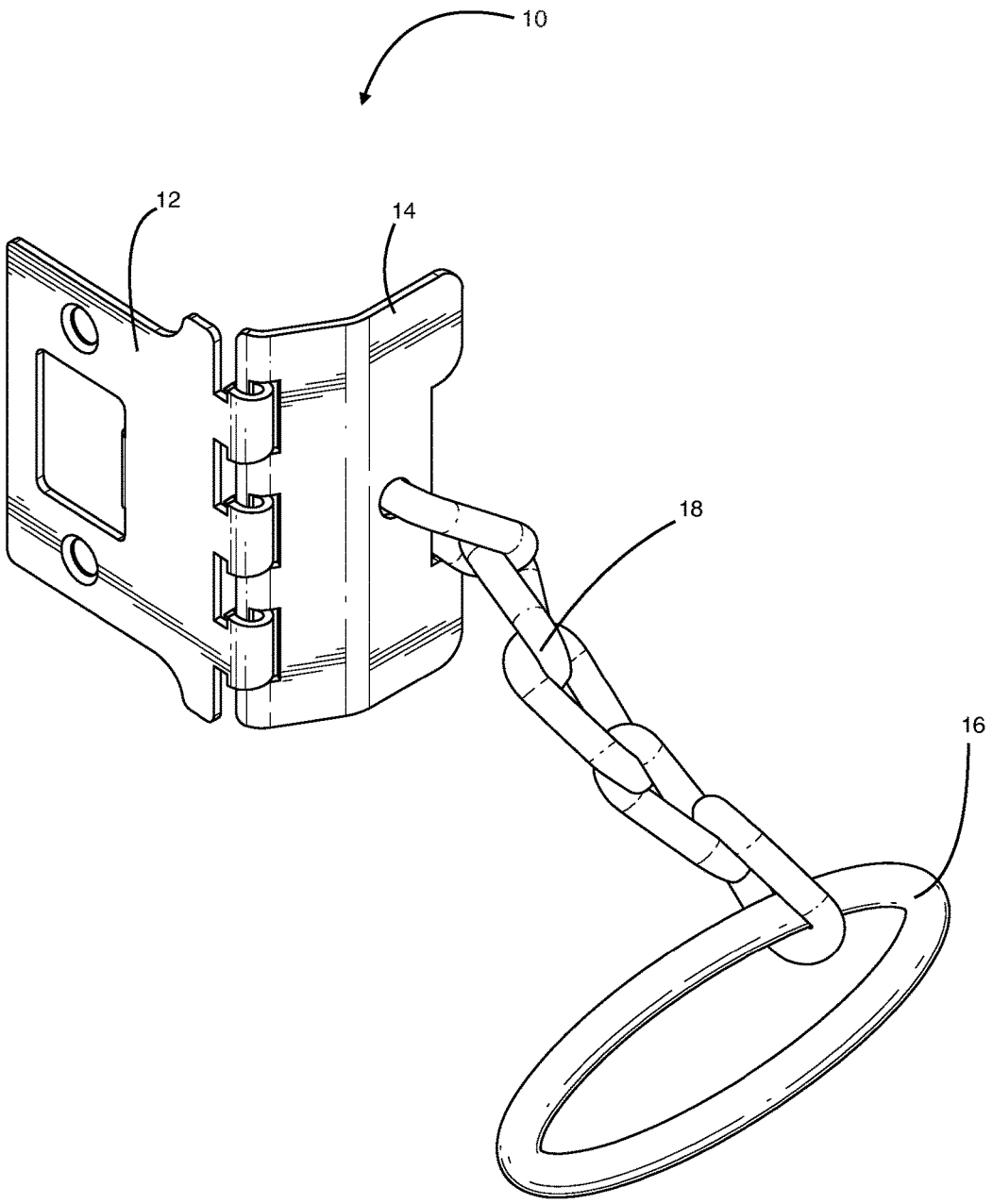
FIG. 1 is a perspective view of an embodiment of a strike plate lock.

The disclosed embodiments may be better understood by referring to the figures in the attached drawings, as provided below. The attached figures are provided as non-limiting examples for providing an enabling description of the apparatus claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

Figure 2:
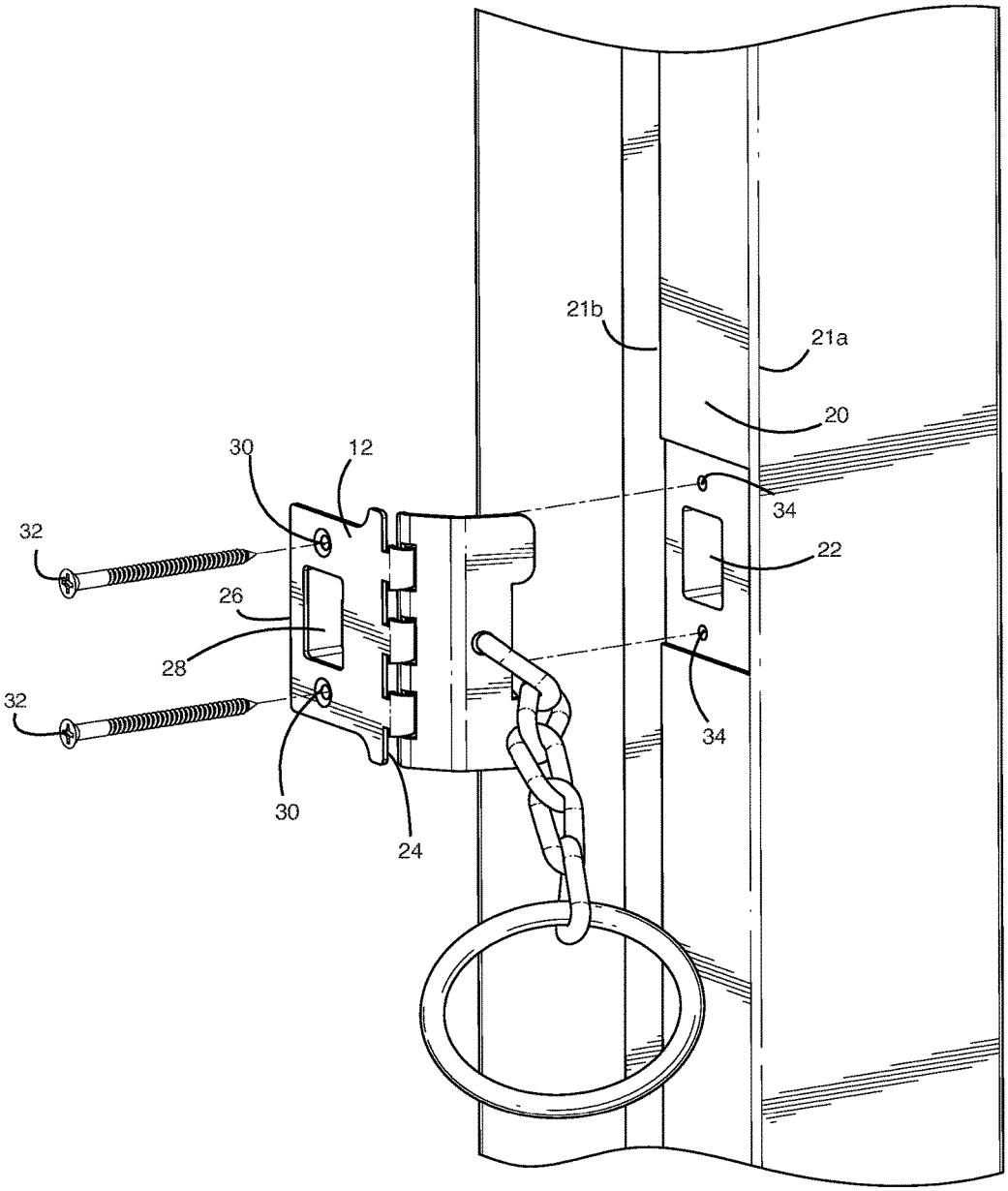
FIG. 2 shows an exploded view of an embodiment of a strike plate lock relative to a door frame.

With reference to FIG. 1 the strike plate lock 10 may comprise a strike plate 12, a flip lock plate 14 extending from the strike plate 12, a catching member 16 here illustrated as a hoop, and a means for linking 18 the catching member 16 to the flip lock plate 14. Drawing attention to FIG. 2, it may be seen that, in an embodiment, the strike plate 12 may be configured to replace any standard strike plate disposed on an inner surface of a door jamb 20 having a cavity 22 to receive a latch or bolt typically used to secure a door in a closed position. Thus, it is contemplated that the strike plate 12 has longitudinally opposed first 24 and second 26 sides and comprises an aperture 28 for receiving a latch disposed between said first and second sides 24, 26.

As with a standard strike plate, the strike plate 10 may be arranged so that, when disposed on the inside of the door jamb 20, the first side 24 longitudinally aligns with a portion of the door jamb 20 in the direction of a hinged door swinging toward an open position 21*a*. Those having skill in the art will recognize that conventional hinged doors are designed to swing into a more private or secure space, thus the first side 24 of the strike plate 12 may be positioned toward the inside of the room or space separated by the door. Likewise, when disposed on the inside of the door jamb 20, the second side 26 may longitudinally align with a portion of the door jamb in the direction of a hinged door swinging toward a closed position 21*b*.

It is contemplated that the strike plate lock may be used then in conjunction with any hinged door arranged to exhibit this typical swinging behavior. For example, it may be used to secure a house, apartment, dorm room, bedroom, hotel room, or other space from intruders. It is even contemplated that the strike flip lock plate may be used in conjunction with inward swinging double doors.

The strike plate 12 may further comprise a plurality of additional apertures 30 for receiving screws, nails, bolts, dowels or any other means for securing the strike plate to the inner surface of the door jamb. In one embodiment, two screws 32 may be used to secure the strike plate 12 to the inner surface of the door jamb 20 as shown, however, it is contemplated that any means of securement will be sufficient to practice the invention. It will be noted that the screws 32 or other means for securing the strike plate 12 to the inner surface of the door jamb 20 may secure the strike plate 12 by entering the door jamb 20 perpendicular to the initial swinging motion of the door. This arrangement may prevent the screws, bolts, or nails from being laterally removed from their secured placement in the door jamb 20 in the event that sufficient force is applied to the door with the strike plate lock engaged. Indeed, it is further contemplated that screws, bolts, or nails of about 1 inch to about 4 inches in length may be provided to effect additional security.

In a preferred embodiment, the strike plate 12 may be disposed on the door jamb 20 in place of a standard strike plate, independent of any need to modify existing structures. It will of course be understood that the screws 32 and apertures 30 may be as numerous or few as necessary to conform to the particular arrangement of the door and door jamb 20. For example, some strike plates are known in the art that have two, three, four, or even more apertures for receiving means for securing the strike plate to the inside of the door jamb. It may be particularly desirable to provide a strike plate conformable to many existing door jamb and strike plate configurations in instances where a user, such as a renting tenant for example, wishes to add security to his or her living space while avoiding physically altering the property in any manner. In some cases, altering the property, such as by putting new holes in existing structures, may constitute damage in breach of a lease agreement or even cause property value to depreciate. Thus it may be desirable to provide a strike plate 12 which avoids the need to add holes or otherwise modify the door and/or door jamb. Instead, in an embodiment, the strike plate 12 may be secured to the inner surface of the door jamb 20 using any existing strike plate screw, bore, or nail holes 34, and screws.

Figure 3:
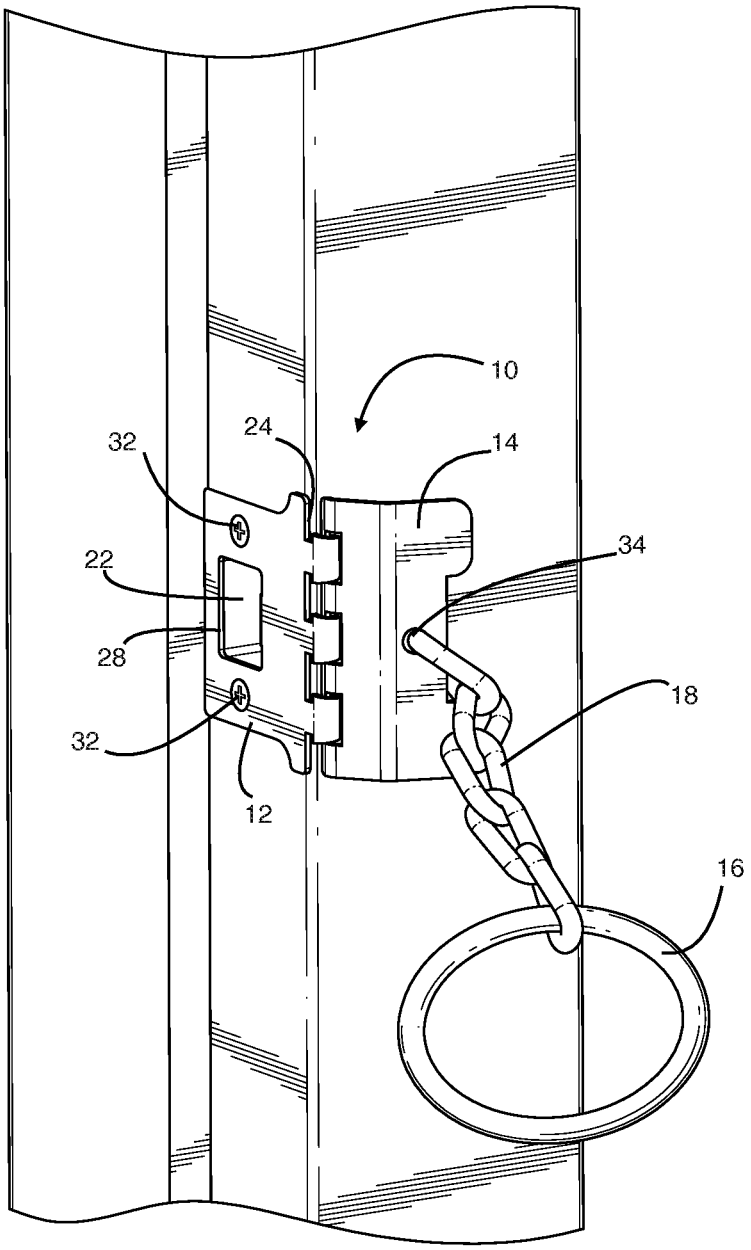
FIG. 3 illustrates an embodiment of a strike plate lock assembled in a door jamb.

Referring now to FIG. 3 an embodiment of the strike plate lock 10 is shown securely engaged by two screws 32 on the inner surface of the door jamb 20 with the aperture 28 and cavity 22 for receiving a door latch or bolt aligned with one another. In one embodiment, the flip lock plate may extend from the first side 24 of the strike plate 12 in the direction of an openly swinging door. Moreover, the means for linking 18 the catching member 16 and flip lock plate 14 may be secured to the flip lock plate 14. For example, in one embodiment, the means for linking 18 the catching member 16 and flip lock plate 14 is a chain having a link on one end looped through an aperture 34 disposed in the flip lock plate 14. The means for linking 18 may of course comprise other materials such as a bar or wire cable.

Figure 4:
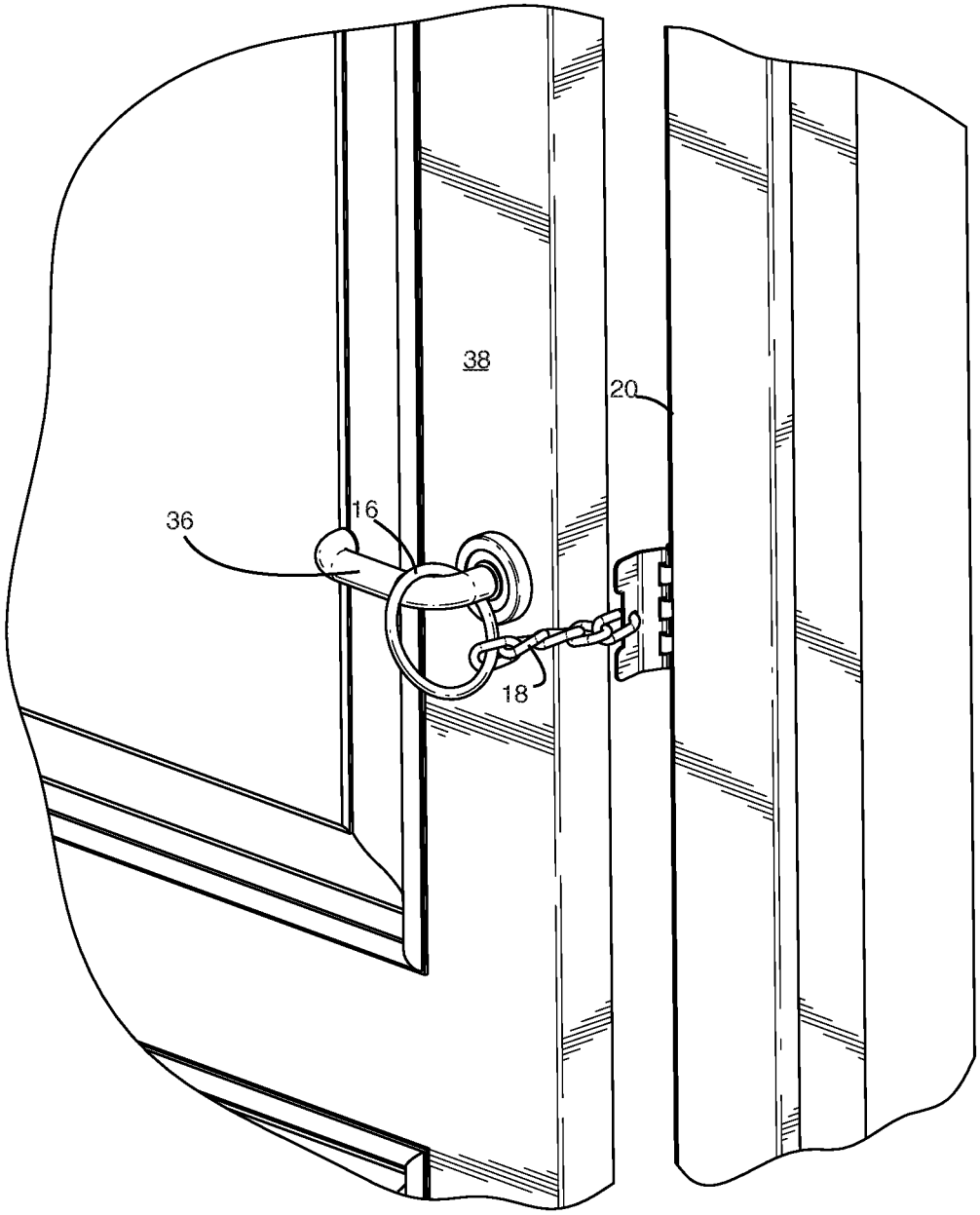
FIG. 4 shows an embodiment of a strike plate lock assembled to prevent a door from opening all the way.

The means for linking 18 the catching member 16 and flip lock plate 14 may moreover have a second end secured to the catching member 16 so that the strike plate 12, flip lock plate 14, and catching member 16 are all linked to one another. Indeed, when the catching member 16 is engaged with the door knob or handle 36 as in FIG. 4, the means for linking 18 may stop the door 38 from opening all the way. Thus, as may be seen in FIG. 4, an open space may be achieved between the door jamb 20 and the door 38 while avoiding the need to make the more protected space vulnerable to intruders or unwelcome guests who would otherwise be able to enter therein.

An embodiment of the catching member 18 is illustrated as a ring or hoop, however one skilled in the art will recognize that any shape able to maintain a removable connection between the door knob or handle 36 and door jamb 20 is sufficient to practice the invention. Thus, in one embodiment, the catching member 16 may be a hook. Of course, the foregoing are offered by way of example and should not be read to limit the strike plate lock.

In one embodiment that the flip lock plate 14 may be hingedly attached to the strike plate so that when the catching member 16 is not engaged around the door knob or hook, it may rest outside of the door jamb 20. In other words, a hinged connection may prevent a disengaged strike plate lock from obstructing the path of a swinging door.

Moreover, providing a hinged connection in this manner may ensure that any force applied to the door 38, and consequently force applied to the means for securing the strike plate to the door jamb while the strike plate lock is in use, may be diffused from the area immediately surrounding the door jamb 20 itself. In combination with the perpendicular placement of the means for securing the strike plate to the door, this may effectively decrease the risk of damaging the door jamb 20. It is also contemplated that this effect may be achieved by providing a flip lock plate 14 that is bent to conform to the shape of an outer side of the door jamb 20. In one embodiment, for example, the hinge may be entirely eliminated and the strike plate 12 and flip lock plate 14 may be formed as a single plate bent to around the corner of the door jamb 20 and facing the direction of the openly swinging door.

Figure 5:
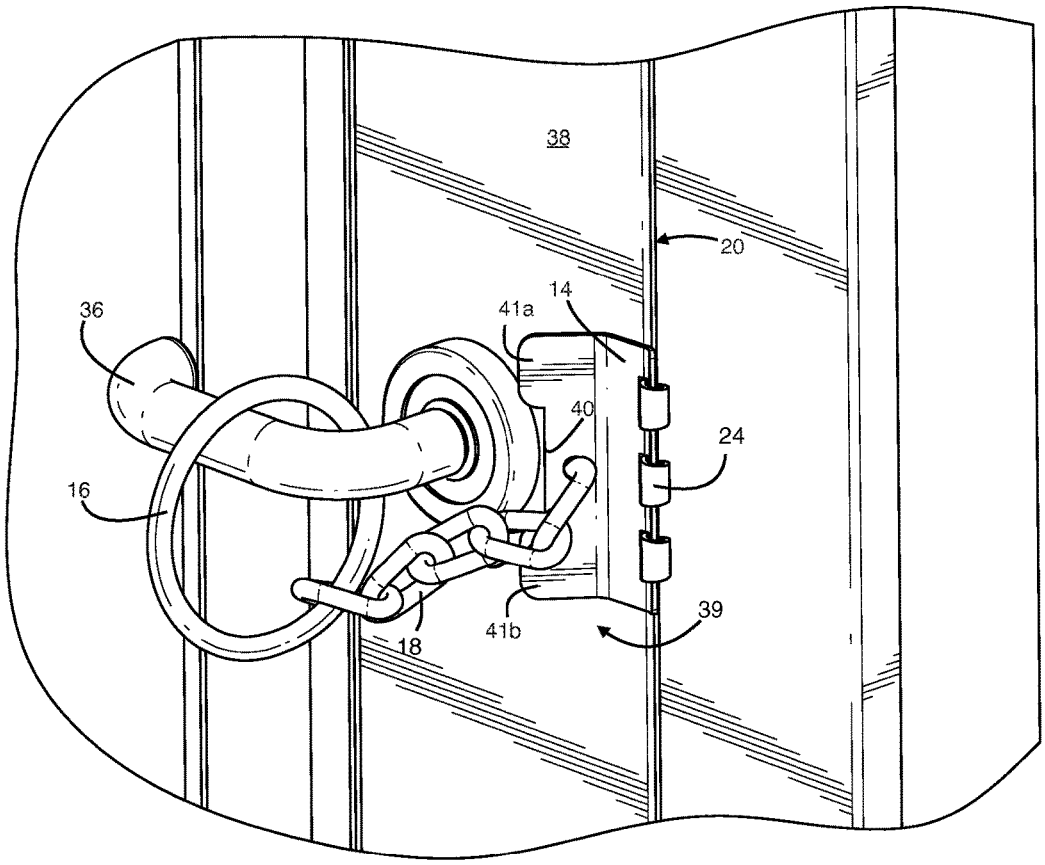
FIG. 5 shows an embodiment of a strike plate lock assembled to prevent a door from opening at all.

With particular reference to FIG. 5 the flip lock plate 14 may hingedly extend from the strike plate 12, as do flip locks typically available in the marketplace, so that it may be engaged over a portion of the door facing the direction of its opening swing. It is contemplated that this may optionally prevent the door 38 from opening at all.

In one embodiment the flip lock plate 14 may be bent. More particularly, the flip lock plate 14 may be bent toward a portion of the door jamb 20 facing the direction of an opening door 38 from a region of the flip lock plate 14 longitudinally spaced apart from the hinged connection joining the first side 24 of the strike plate and flip lock plate 14. As such, when hingedly flipped according to arrow 39 to prevent the door 38 from opening, as demonstrated in FIG. 5, the portion of the flip lock plate 14 closest to the door jamb 20 may lie flat on the door 38, while the bent portion lifts away from the door 38. This may allow the catching member 16 and means for linking 18 to hang behind or in front of the flip lock plate 14 so that use of the strike plate lock remains unobstructed.

To further avoid obstructing use of the strike plate lock and even the door knob or handle 36, the flip lock plate 14 may further comprise a notch 40 taken from an edge of the flip lock plate 14 that is longitudinally opposed to the hinged connection joining the first side 24 of the strike plate and flip lock plate 14. The notch may define a top wing 41*a* and bottom wing 41*b* may be sized to receive the door knob or handle 36 between said wings. Configured as such, it is contemplated that the flip lock plate 14 may be fully engaged against the door 38 At the same time, the winged portions on the outer edge of the plate 14 should surround the door knob/handle.

With reference again to FIG. 1, the strike plate 12, flip lock plate 14, catching member 16, and means for linking 18 the catching member and flip lock plate may comprise any rugged material capable of withstanding repeating tugging, pushing, or pulling forces. For example, the strike plate 12, flip lock plate 14, catching member 16, and means for linking 18 the catching member and flip lock plate may comprise pure or alloyed metal. In one embodiment, the metal may be stainless steel known in the art for its particular durability and strength. The thickness, diameter, and length of the catching member 16 and means for linking 18 may vary depending on the size of the door knob or handle as well as size of the door frame itself. For example, in an embodiment wherein the means for linking 18 is a chain, chain may be formed from 16 gauge metal links extending together about 5 to about 10 inches in length. Likewise, the catching member 16 may be about 2 to about 4 inches in diameter. Of course, such measurements are offered by way of example only and not of limitation. Indeed, it is contemplated that the strike plate 12, flip lock plate 14, catching member 16, and means for linking 18 the catching member and means for linking the catching member and flip lock plate may comprise various other materials or combinations of materials of various sizes that are capable of withstanding the force of a potential intruder. Indeed, the rugged material may be chosen from stainless steel, steel, aluminum, or even iron. Such materials may be further combined with additional materials such as chromium and nickel to increase durability, hardness, and corrosion resistance.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. For example, the configuration of the apertures on the strike plate may be adjusted according to the configuration of the door and door jamb. Moreover, the means for linking the flip lock plate and catching member may be attached to the flip lock plate by various means and at various locations on the flip itself. Accordingly, it is intended that the invention not be limited, except as by the appended claim(s).

The teachings disclosed herein may be applied to other devices, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the strike plate lock with which that terminology is associated. In general, the terms used in the following claims should not be constructed to limit the strike plate lock to the specific embodiments disclosed in the specification unless the above description section explicitly define such terms. Accordingly, the actual scope encompasses not only the disclosed embodiments, but also all equivalent ways of practicing or implementing the disclosed apparatus. The above description of embodiments of the strike plate lock is not intended to be exhaustive or limited to the precise form disclosed above or to a particular field of usage.

While specific embodiments of, and examples for, the method, system, and apparatus are described above for illustrative purposes, various equivalent modifications are possible for which those skilled in the relevant art will recognize.

While certain aspects of the method and system disclosed are presented below in particular claim forms, various aspects of the apparatus are contemplated in any number of claim forms. Thus, the inventor reserves the right to add additional claims after filing the application to pursue such additional claim forms for other aspects of the strike plate lock.

What is claimed is:

1. A strike plate lock for a hinged door, comprising:

a strike plate having a) longitudinally opposed first and second sides;

b) a top side and a bottom side;

c) an aperture disposed between the first and second sides to receive a latch bolt;

d) a plurality of additional apertures disposed between the first and second sides to receive means for securing the strike plate to an inside of a door jamb;

e) a top corner protrusion disposed on the top side, wherein the top corner protrusion extends away from the top side; and f) a bottom corner protrusion disposed on the bottom side, wherein the bottom corner protrusion extends away from the bottom side;

a flip lock plate having a first flip lock side and a second flip lock side, wherein the first flip lock side and the second flip lock side are longitudinally opposed, wherein the first flip lock side is hingedly connected to the first side of the strike plate and operative to optionally forcibly block a door from swinging open, and wherein the second flip lock side defines a top wing that extends away from the second flip lock side, a bottom wing that extends away from the second flip lock side, and a portion of the second flip lock side between the top wing and the bottom wing that is sized to receive a standard-sized door knob or handle;

a hole disposed on the flip lock plate;

a hoop of fixed shape sized to receive a door knob or handle; and a chain-shaped means for linking the hoop to the flip lock plate, wherein the chain-shaped means for linking the hoop has at least one link having a center link cavity wherein the at least one link is configured to encompass a portion of the flip lock plate located between the hole and the second flip lock side within the center link cavity;

wherein the strike plate is configured so that when secured to the door jamb, the first side aligns with a portion of the door jamb facing a direction of an opening door and the second side aligns with a portion of the door jamb facing a direction of a closing door.

2. The strike plate lock of claim 1, wherein the plurality of additional apertures are arranged on the strike plate to align with one or more of bores and screw holes already existing in the door jamb so that the strike plate may replace a standard strike plate while avoiding the need to modify the door jamb to accommodate it.

3. The strike plate lock of claim 1, wherein the flip lock plate is outwardly bent toward the portion of the door jamb facing the direction of the opening door from a region of the flip lock plate longitudinally spaced apart from the first side of the strike plate hingedly connected to the flip lock plate.

4. The strike plate lock of claim 1, wherein the chain-shaped means for linking the hoop to the flip lock plate is an uncovered chain.

5. The strike lock plate of claim 1, wherein the means for securing the strike lock plate to the door jamb comprises a plurality of elongated screws.

6. A strike plate lock for a hinged door, comprising:

a strike plate having a) longitudinally opposed first and second sides;

b) a top side and a bottom side;

c) an aperture disposed between the first and second sides to receive a latch bolt;

d) a plurality of additional apertures disposed between the first and second sides to receive means for securing the strike plate to an inside of a door jamb;

e) a top corner protrusion disposed on the top side, wherein the top corner protrusion extends away from the top side; and f) a bottom corner protrusion disposed on the bottom side, wherein the bottom corner protrusion extends away from the bottom side;

a flip lock plate having a first flip lock side and a second flip lock side, wherein the first flip lock side and the second flip lock side are longitudinally opposed, wherein the first flip lock side has a hinged connection configured to hingedly connect the first flip lock side to the first side of the strike plate, wherein the flip lock plate is outwardly bent toward a portion of the door jamb facing a direction of an opening door from a region of the flip lock plate longitudinally spaced apart from the hinged connection joining the flip lock plate to the first side of the strike plate, and wherein the second flip lock side defines a top wing that extends away from the second flip lock side, a bottom wing that extends away from the second flip lock side, and a portion of the second flip lock side between the top wing and the bottom wing that is sized to receive a standard-sized door knob or handle therebetween;

a hoop sized to receive the door knob or handle; and a chain for linking the hoop to the flip lock plate, wherein the strike plate is configured so that when secured to the door jamb, the first side aligns with the portion of the door jamb facing the direction of the opening door and the second side aligns with a portion of the door jamb facing the direction of a closing door.

7. The strike plate lock of claim 6, wherein the plurality of additional apertures are arranged on the strike plate to align with one or more of bores and screw holes already existing in the door jamb so that the strike plate may replace a standard strike plate while avoiding the need to modify the door jamb to accommodate it.

8. The strike plate lock of claim 6, wherein the means for securing the strike plate to the door jamb comprises a plurality of elongated screws.

9. A strike lock plate, comprising:

a strike plate, comprising:

a) a strike plate front side;

b) a strike plate back side;

c) a strike plate top side;

d) a strike plate bottom side;

e) a strike plate first side;

f) a strike plate second side;

g) at least one protrusion disposed on the strike plate second side, comprising:

a. an extension portion having a top extension side and a bottom extension side;

b. at least one cylinder portion having a cylinder portion top-inside side, a cylinder portion top side, a cylinder portion outside side; a cylinder portion bottom side, a cylinder portion bottom-inside side, and a cylinder portion center axis, wherein the cylinder portion top side extends further than the top extension side, and wherein the cylinder portion bottom side extends further than the bottom extension side; and c. a protrusion aperture, wherein the protrusion aperture is configured to transverse the at least one cylinder portion from the cylinder portion top side to the cylinder portion bottom side along the cylinder portion center axis;

h) at least one notch defined by a space between the strike plate second side, the top extension side, and the cylinder portion top-inside side;

i) a rectangular aperture disposed on the strike plate first side, wherein the rectangular aperture is configured to transverse the strike plate, wherein the rectangular aperture is configured to receive a latch bolt, wherein the rectangular aperture has a rectangular aperture first long side, a rectangular aperture second long side, a rectangular aperture top short side and a rectangular aperture bottom short side, wherein the rectangular aperture first long side runs parallel with the strike plate first side, and wherein the rectangular aperture second long side runs parallel to the strike plate second side;

j) a first threaded element aperture disposed on the strike plate front side, wherein the first threaded element aperture is configured to transverse the strike plate, and wherein the first threaded element aperture is disposed on the strike plate front side between the rectangular aperture top short side and the strike plate top side;

k) a second threaded element aperture disposed on the strike plate front side, wherein the second threaded element aperture is configured to transverse the strike plate, and wherein the second threaded element aperture is disposed on the strike plate front side between the rectangular aperture bottom short side and the strike plate bottom side;

l) a top corner protrusion comprising a corner between the strike plate top side and the strike plate second side, wherein the top corner protrusion has a top corner first side, a top corner outer side, and a top corner second side, wherein the top corner first side represents an undifferentiated extension of the strike plate first side, wherein the top corner outer side runs parallel to the strike plate top side, and wherein the top corner second side comprises an arcuate edge connecting the top corner outer side and the strike plate top side, and wherein the top corner protrusion extends away from the strike plate top side; and m) a bottom corner protrusion comprising a corner between the strike plate bottom side and the strike plate second side, wherein the bottom corner protrusion has a bottom corner first side, a bottom corner outer side, and a bottom corner second side, wherein the bottom corner first side represents an undifferentiated extension of the strike plate first side, wherein the bottom corner outer side runs parallel to the strike plate bottom side, and wherein the bottom corner second side comprises an arcuate edge connecting the bottom corner outer side and the strike plate bottom side, and wherein the bottom corner protrusion extends away from the strike plate bottom side;

a flip lock plate, comprising:

a) a first flip lock portion, comprising:

a. a first flip lock portion front side;

b. a first flip lock portion back side;

c. a first flip lock portion top side;

d. a first flip lock portion bottom side;

e. a first flip lock portion first side;

f. a first flip lock portion second side;

g. at least one first flip lock portion aperture disposed on the first flip lock portion front side, wherein the at least one first flip lock portion aperture is configured to transverse the first flip lock portion, wherein the at least one first flip lock portion aperture has a first flip lock portion aperture first side and a first flip lock portion aperture second side, and wherein the at least one flip lock portion aperture is configured to receive the cylinder portion outside side;

h. at least one flip lock hinge-insert portion, wherein the at least one flip lock hinge-insert portion comprises an area of the first flip lock portion located between the first flip lock portion aperture first side and the first flip lock portion first side, wherein the at least one flip lock hinge-insert portion is configured to rotate within the protrusion aperture; and b) a second flip lock plate portion, comprising:

a. a second flip lock portion front side having a central front side portion;

b. a second flip lock portion back side;

c. a second flip lock portion top side;

d. a second flip lock portion bottom side;

e. a second flip lock portion first side;

f. a second flip lock portion second side;

g. a central circular aperture disposed on the central front side portion, wherein the central circular aperture transverses the second flip lock plate portion;

h. a first flip lock plate end protrusion comprising a corner between the second flip lock portion top side and the second flip lock portion second side, wherein the first flip lock plate end protrusion extends away from the second flip lock portion second side; and i. a second flip lock plate end protrusion comprising a corner between the second flip lock portion bottom side and the second flip lock portion second side, wherein the second flip lock plate end protrusion extends away from the second flip lock portion second side; and j. a flip lock notch disposed on the second flip lock portion second side between the first flip lock plate end protrusion and the second flip lock plate end protrusion, wherein the flip lock notch is configured to surround a standard-sized doorknob or door handle, and wherein the flip lock notch is longitudinally opposed to the second flip lock portion first side;

a chain having a first terminal link, at least one intermediate link, and a second terminal link, wherein each link has a perimeter portion configured to connect to itself and a link cavity, wherein the first terminal link perimeter portion is configured to pass through the central circular aperture, around the notch, through the link cavity of the intermediate link, then connect to itself, thereby encompassing a portion of the second flip lock plate portion within the link cavity; and a hoop of fixed shape configured to encircle a door handle, wherein the hoop is configured to pass through the second terminal link.

10. The strike lock plate of claim 9, further comprising an angled junction between the first flip lock plate portion and the second flip lock plate portion.

11. The strike lock plate of claim 10, wherein the angle of the angled junction on the side of the flip lock plate comprising the first flip lock portion back side and the second flip lock portion back side is less than 180 degrees.

12. The strike lock plate of claim 9, further comprising two additional links in the chain between the first terminal link and the second terminal link, wherein all four links in the chain are chain-linked.

13. The strike lock plate of claim 9, comprising three protrusions, three first flip lock portion apertures, and three flip lock hinge-insert portions.

14. The strike lock plate of claim 9, further comprising at least one flip lock stop-position portion, wherein the at least one flip lock stop-position portion comprises the area of the first flip lock portion located between the at least one first flip lock portion aperture top side and the first flip lock portion top side.

* * * * *